United States Patent [19]

Wiedenfeld et al.

[11] 4,241,480

[45] Dec. 30, 1980

[54] COMB SECTION PAIR OF AN EXPANSION COMB

[75] Inventors: Helmut Wiedenfeld, both of Mönchan-Gladbach; Peter Reinardy, both of Monchen-Gladbach, Fed. Rep. of Germany

[73] Assignee: W. Schlafhorst & Co., Mönchen-Gladbach, Fed. Rep. of Germany

[21] Appl. No.: 59,585

[22] Filed: Jul. 23, 1979

[51] Int. Cl.[3] ..... D02H 13/18

[52] U.S. Cl. ..... 28/213

[58] Field of Search ..... 28/199, 212, 213, 282

[56] References Cited

U.S. PATENT DOCUMENTS 2,178,452 10/1939 Kaufmann ..... 28/213

FOREIGN PATENT DOCUMENTS 922185 3/1963 United Kingdom ..... 28/213

*Primary Examiner*—Robert Mackey

*Attorney, Agent, or Firm*—Herbert L. Lerner

[57] ABSTRACT

Comb section pair of an articulating expansion comb for processing textile threads or filamentary wires, including a first and a second comb section pivotally joined together at an axis of rotation in the vicinity of an end of each comb section, a group of comb needles disposed on each comb section in a respective alignment plane, each of the comb needles being mutually spaced apart by a given comb needle division, the alignment planes intersecting at the axis of rotation, the axis of rotation extending exclusively through the comb needle group of the first comb section, a last comb needle of the comb needle group on the first comb section being disposed at least one comb needle division beyond the axis of rotation toward the end of the first comb section, a first comb needle disposed closest to the end of the second comb section being at most one comb needle division farther from the axis of rotation than the last comb needle of the first comb section.

1 Claim, 2 Drawing Figures

COMB SECTION PAIR OF AN EXPANSION COMB

Figure 1:
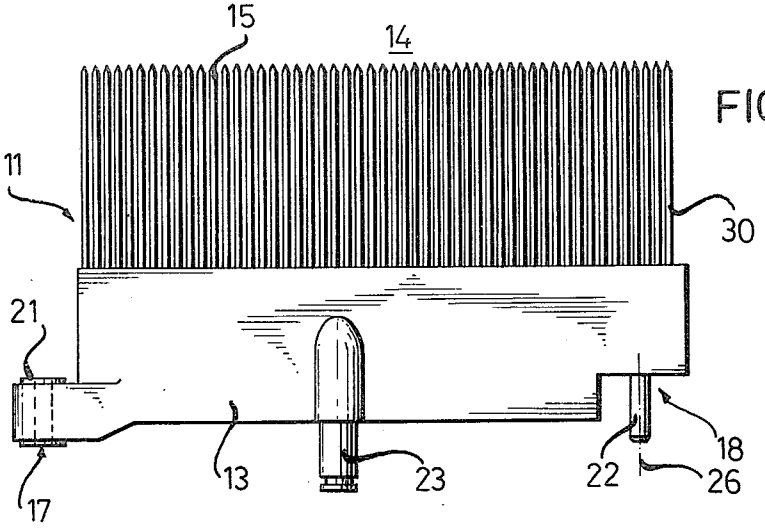

The invention relates to a comb section pair of an expansion comb of articulating construction for processing textile threads or filamentary wires, especially for warping or beaming machines, in which the axis of rotation of the joint connecting the comb sections is located at the crossing of the alignment planes of the comb needle groups, and extends exclusively through the comb needle group of the first comb section.

It is well known that expansion combs of articulating construction include comb sections or comb section pairs which are connected to each other in an articulating manner. Each comb section of an expansion comb is connected to the adjacent comb by a hinge joint. A pair of comb sections therefore is likewise connected together by such a joint. In addition, a comb section can also have a swivel axis between hinge joints. Two comb sections can be rotated about their swivel axes, for instance, by varying the distance of the swivel axes from each other along a staight line. The hinge joints of the comb sections can also be connected to each other in the manner of "Nuremberg scissors".

If the angular position of a comb section pair is changed, all the angles between the comb sections change. This also changes the overall length of the expansion comb.

Up to now, the last comb needle of the comb needle group in the first comb section of a comb section pair was located in the extreme case over the joint in the joint axis. With close comb needle pitch, such placement presented difficulties. It was not possible to bring the comb needle group of the second comb section close enough to the comb needle group of the first comb section. In the case of close comb needle pitch, a larger comb needle spacing, i.e., nonuniformity of the comb needle pitch, had therefore to be tolerated over the joints.

It is accordingly an object of the invention to provide a comb section pair of an expansion comb which overcomes the hereinfore mentioned disadvantages of the heretofore known devices of this general type, and to make the comb needle pitch, as seen in the direction of the (warp) threads, uniform at all points for all possible angular positions of the expansion comb, even if the spacing of the comb needles is very small.

With the foregoing and other objects in view there is provided, in accordance with the invention, a comb section pair of an articulating expansion comb for processing textile threads or filamentary wires, comprising a first and a second comb section pivotally joined together at an axis of rotation in the vicinity of an end of each comb section, a group of comb needles disposed on each comb section in a respective alignment plane, each of the comb needles being mutually spaced apart by a given comb needle division, the alignment planes intersecting at the axis of rotation, the axis of rotation extending exclusively through the comb needle group of the first comb section, a last comb needle of the comb needle group on the first comb section being disposed least one comb needle division beyond the axis of rotation toward the end of the first comb section, a first comb needle disposed closest to the end of the second comb section being at most one comb needle division farther from the axis of rotation than the last comb needle of the first comb section.

The advantages obtained with the invention are in particular that the warping or beaming of thin threads by means of an expansion comb becomes qualitatively better because a closer comb needle pitch can be chosen, so that fewer threads are conducted between the individual comb needles and nonuniformities of the comb needle pitch necessitated by the joint configurations no longer exist.

Other features which are considered as characteristic for the invention are set forth in the appended claims.

Although the invention is illustrated and described herein as embodied in a comb section pair of an expansion comb, it is nevertheless not intended to be limited to the details shown, since various modifications and structural changes may be made therein without departing from the spirit of the invention and within the scope and range of equivalents of the claims.

Figure 2:
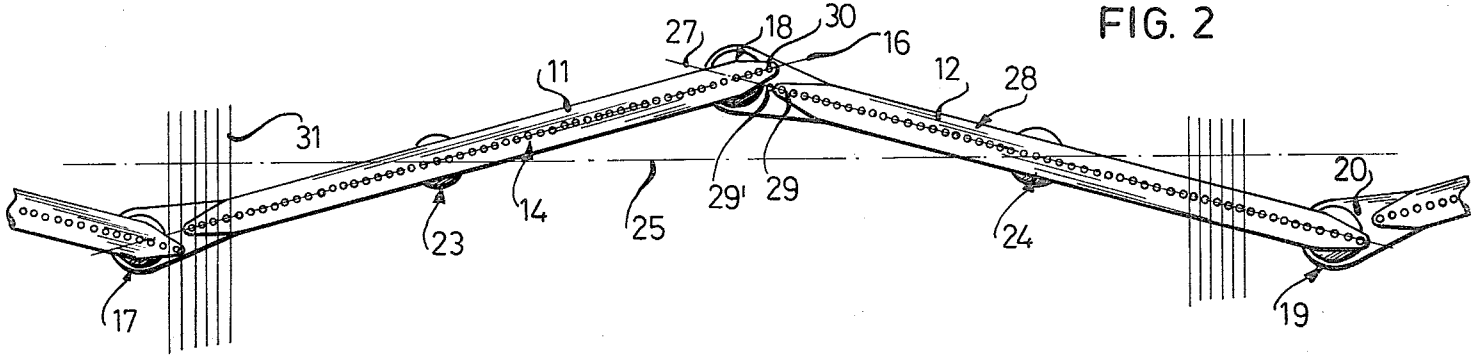

The construction and method of operation of the invention, however, together with additional objects and advantages thereof will be best understood from the following description of specific embodiments when read in connection with the accompanying drawings, in which:

FIG. 1 is a diagrammatic side elevational view of a comb section according to the invention; and FIG. 2 is a top plan view of a comb section pair.

Referring now as a whole to the figures of the drawing, there is seen a pair of comb sections including, first and second comb sections 11 and 12, respectively. Individually, the two comb sections are of completely identical construction. Therefore, the first comb section 11 shown in FIG. 1 is representative of the entire expansion comb, not shown in detail.

On the comb carrier 13 of the comb section 11 is mounted a comb needle group 14, including individual comb needles 15 which are mutually spaced apart in an alignment plane 16 with the same distance between their centers, called the comb needle pitch. Joints 17, 18, 19 can also be seen between the comb sections. At the joint 18, the comb sections 11, 12 are connected to form a comb section pair. The joint 17 provides a connection to the next comb section pair to the left and the joint 19 provides a connection to the next comb section pair to the right, as seen in FIG. 2. At the joint 17, the first comb section 11 has a bearing bushing 21 which is inserted into the comb carrier 13 formed of synthetic material such as plastic. At the joint 18, the first comb section 11 has a pin 22 which fits the bearing bushing of the second comb section 12.

On the underside of the comb carrier 13, a swivel axis 23 can be seen. The swivel axis is located at one-half the distance between the joints 17 and 18. In a similar construction, the second comb section 12 has a swivel axis 24. The swivel axes 23, 24 can be shifted along the straight line 25, so that the comb section pair 11, 12 can be shortened and lengthened in scissor fashion.

The axis of rotation 26 of the joint 18 connecting the comb sections 11, 12 is located at the crossing or intersection of the respective alignment planes 16, 27 of the comb needle groups 14, 28 of the two comb sections 11, 12. The comb needle group 14 of the first comb section 11 extends beyond the axis of rotation 26 of the joint 18 by three comb needle divisions. Therefore, the last comb needle 30 of the first comb section 11 is removed from the axis of rotation 26 by three comb needle divisions. The first comb needle 29 of the second comb section 12 is one needle division farther removed from the axis of rotation 26 than the last comb needle 30 of the first comb section 11.

In FIG. 2, there is further seen an assembly of threads, including individual threads 31, which lead through the gaps between the comb needles 15. According to FIG. 2, the distance projections of the comb needles are perfectly uniform. The uniformity is also not changed for other angular positions of the alignment planes 16 and 27. FIG. 2 additionally shows that the axis of rotation 26 of the joint 18 connecting the comb sections 11, 12 extends exclusively through the comb needle group 14 of the first comb section 11.

It would have a detrimental effect if the first comb needle 29 of the second comb section 12 were removed one comb needle division farther from the axis of rotation 26 than is shown in the drawing. It would do no harm, however, if the first comb needle 29 were to assume the position 29'. However, the possible movement of the comb section pair with respect to its angular position would then be somewhat limited.

The invention is not limited to the embodiment example shown and described. Within the scope of the claims and other statements regarding the invention, modified embodiment examples are also possible.

We claim:

1. Comb section pair of an articulating expansion comb for processing textile threads or filamentary wires, comprising a first and second comb section pivotally joined together at an axis of rotation in the vicinity of an end of each comb section, a group of comb needles disposed on each comb section in a respective alignment plane, each of said comb needles being mutually spaced apart by a given comb needle division, said alignment planes intersecting at said axis of rotation, said axis of rotation extending exclusively through said comb needle group of said first comb section, a last comb needle of said comb needle group on said first comb section being disposed at least one comb needle division beyond said axis of rotation toward said end of said first comb section, a first comb needle disposed closest to said end of said second comb section being at most one comb needle division farther from said axis of rotation than said last comb needle of said first comb section.

* * * * *